United States Patent [19]

Albertson

[11] Patent Number: 4,711,367

[45] Date of Patent: Dec. 8, 1987

[54] TRASH CONTAINER

[76] Inventor: Robert V. Albertson, 2100 Shadywood Rd., Wayzata, Minn. 55391

[21] Appl. No.: 793,848

[22] Filed: Nov. 1, 1985

[51] Int. Cl.[4] ..... B65D 90/04; B65D 90/12; B65D 5/60; B65D 5/34

[52] U.S. Cl. ..... 220/404; 229/145; 248/95

[58] Field of Search ..... 220/403, 404, 407; 229/44 R; 206/476, 482; 248/95, 97, 98, 99, 101

[56] References Cited

U.S. PATENT DOCUMENTS

| | | | |
|---|---|---|---|
| 1,477,241 | 12/1923 | Carson | 206/482 |
| 1,901,188 | 3/1933 | Phillips | 206/476 |
| 2,141,752 | 12/1938 | Hoarle | 229/44 R |
| 2,202,238 | 5/1940 | Thompson | 220/404 |
| 3,100,074 | 8/1963 | Beck | 229/44 R |
| 3,458,113 | 7/1969 | Swartzbaugh | 229/44 R |
| 3,484,017 | 12/1969 | O'Donnell | 220/404 |
| 3,737,129 | 6/1973 | Foster . | |
| 3,760,975 | 9/1973 | Nilsson | 220/404 |
| 4,280,676 | 7/1981 | Betts . | |

FOREIGN PATENT DOCUMENTS

| | | | |
|---|---|---|---|
| 888013 | 12/1971 | Canada | 220/404 |
| 1271791 | 4/1972 | United Kingdom | 220/407 |

*Primary Examiner*—George E. Lowrance
*Attorney, Agent, or Firm*—Burd, Bartz & Gutenkauf

[57] ABSTRACT

A portable trash container for holding a removable plastic bag for storing paper, bottles, cans, and like trash. The container includes a body member having a rectangular cavity with a hinged cover and a reinforced bottom. The bag is inserted into the cavity and the open end of the bag is folded over the top perimeter of the body member. The bag is held in place when part of the open end of the bag is slid into inwardly directed slots located at the junction between the rear wall of the body member and the cover. The container is coupled to a fixed object by a pair of straps which have a first end joined to the rear wall and a second end having an elongated cross head. The cross heads extend through slots in the rear wall of the body member to form a loop around the fixed object.

17 Claims, 8 Drawing Figures

11
27
26
22
24
23
38
22
30
41
4
29
27
24
37
4
10
16
13

3
10
22
11
23
26
37
14
44
46
43
49
47
48
17
3

10

22
23
26
38
39
42
41
24
17
16
14

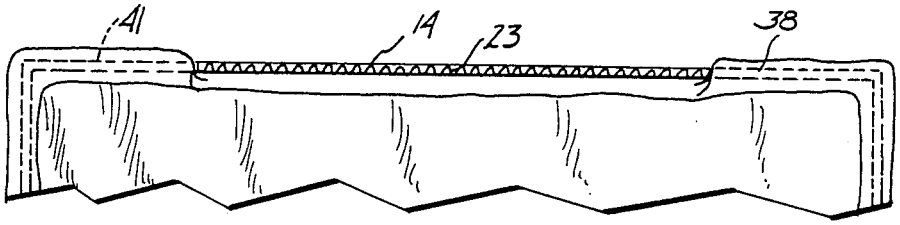
Fig.6
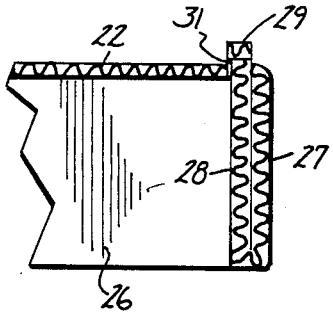
Fig.4
Fig.8
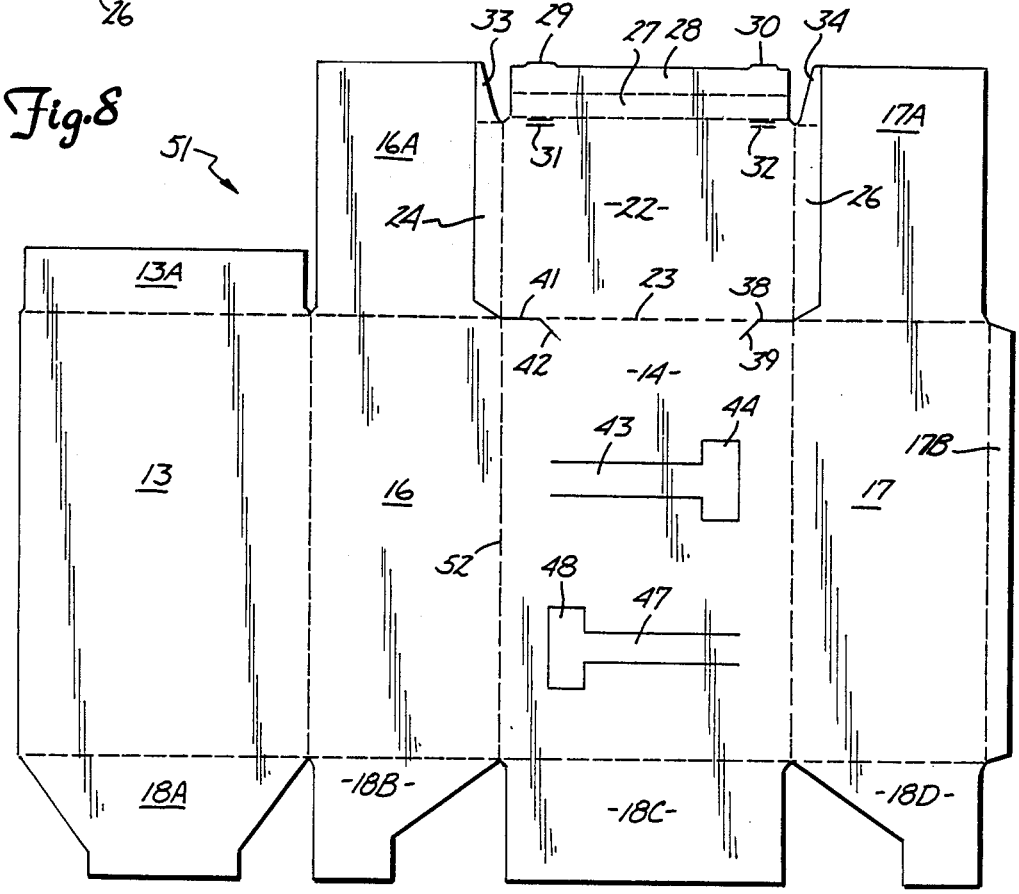

TRASH CONTAINER

BACKGROUND OF THE INVENTION

This invention relates to an apparatus for storing paper, bottles, cans, and like trash in a supported plastic bag. In the past, various structures have been used to support plastic bags while the bags were being filled. Devices for supporting bags are disclosed by Foster in U.S. Pat. Nos. 3,737,129 to Foster and 4,280,676 to Betts. These devices have upright side walls providing supports for flexible plastic bags.

Prior devices for collecting trash in plastic bags have had many disadvantages. One major difficulty is that the containers supporting the plastic bags are bulky, burdensome, and heavy. This makes shipment, mobility, and storage impractical. Another common difficulty is storing empty devices. Often a facility must store the devices in a confined area when not in use. When space is limited, not all of the devices may be stored properly.

SUMMARY OF THE INVENTION

This invention is directed to a container for collecting trash, such as paper, bottles, cans, and other refuse, in a bag. The container of the invention is a lightweight box means accommodating a bag for storing trash which can be readily attached to a variety of fixed objects. The box means includes a normally closed cover.

The trash container comprises a box structure having a front wall, a rear wall, and a pair of side walls attached to bottom wall which provide an inner chamber. The four walls surround a chamber having an open top. A cover, hinged to the rear wall, closes the open top. The walls and cover are foldable flat to facilitate storage and shipment. At the junction of the cover and the rear wall are inwardly directed slots and angled slits for accommodating a replaceable trash bag located in the chamber. A retainer comprising a pair of straps joined to the rear wall hold the container adjacent a fixed object. Each strap has a cross head. A pair of T-shaped slots are located in the rear wall for accommodating the straps. The slots allow the cross heads of the straps to extend through the slots and engage with the rear wall to form loops used to couple the box to a fixed object.

DESCRIPTION OF DRAWINGS

FIG. 4 is an enlarged sectional view taken along the line 4—4 of FIG. 1;

FIG. 6 is a top view of the rear of the container holding the replaceable bag;

FIG. 8 is a plan view of the flat sheet member adapted to be folded into the container.

DESCRIPTION OF PREFERRED EMBODIMENT

Figure 1:
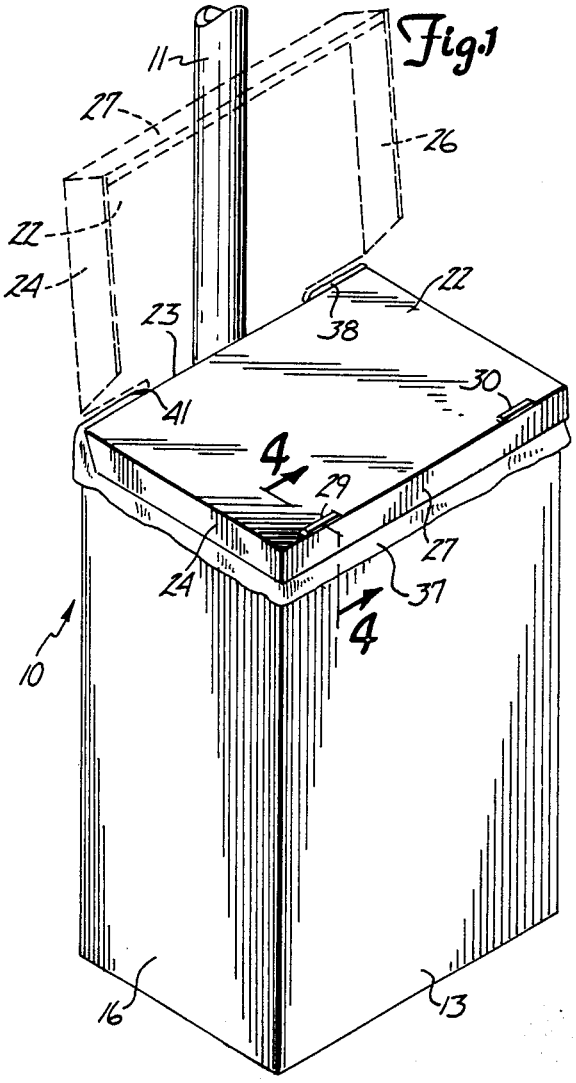
FIG. 1 is a front perspective view of the trash container of the invention.
Figure 2:
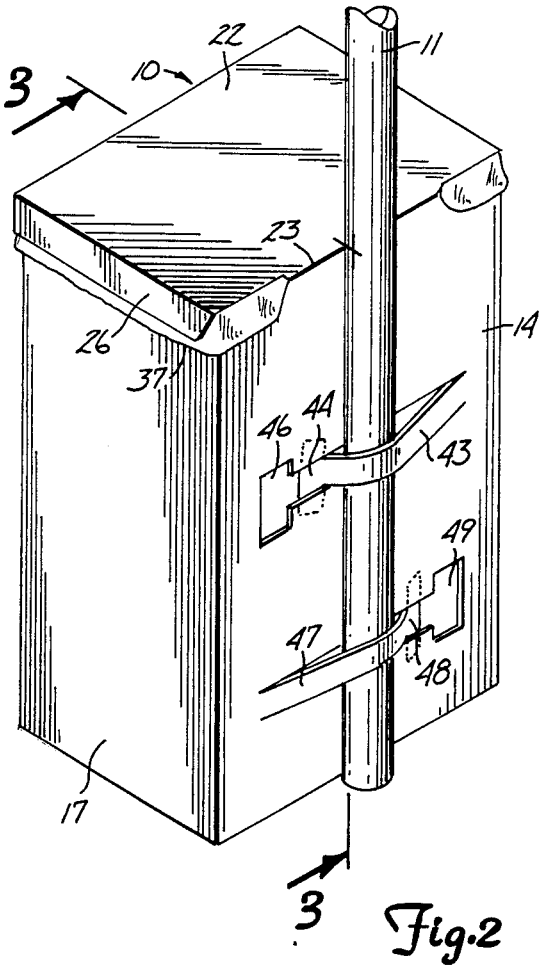
FIG. 2 is a rear perspective view of the trash container of FIG. 1.
Figure 3:
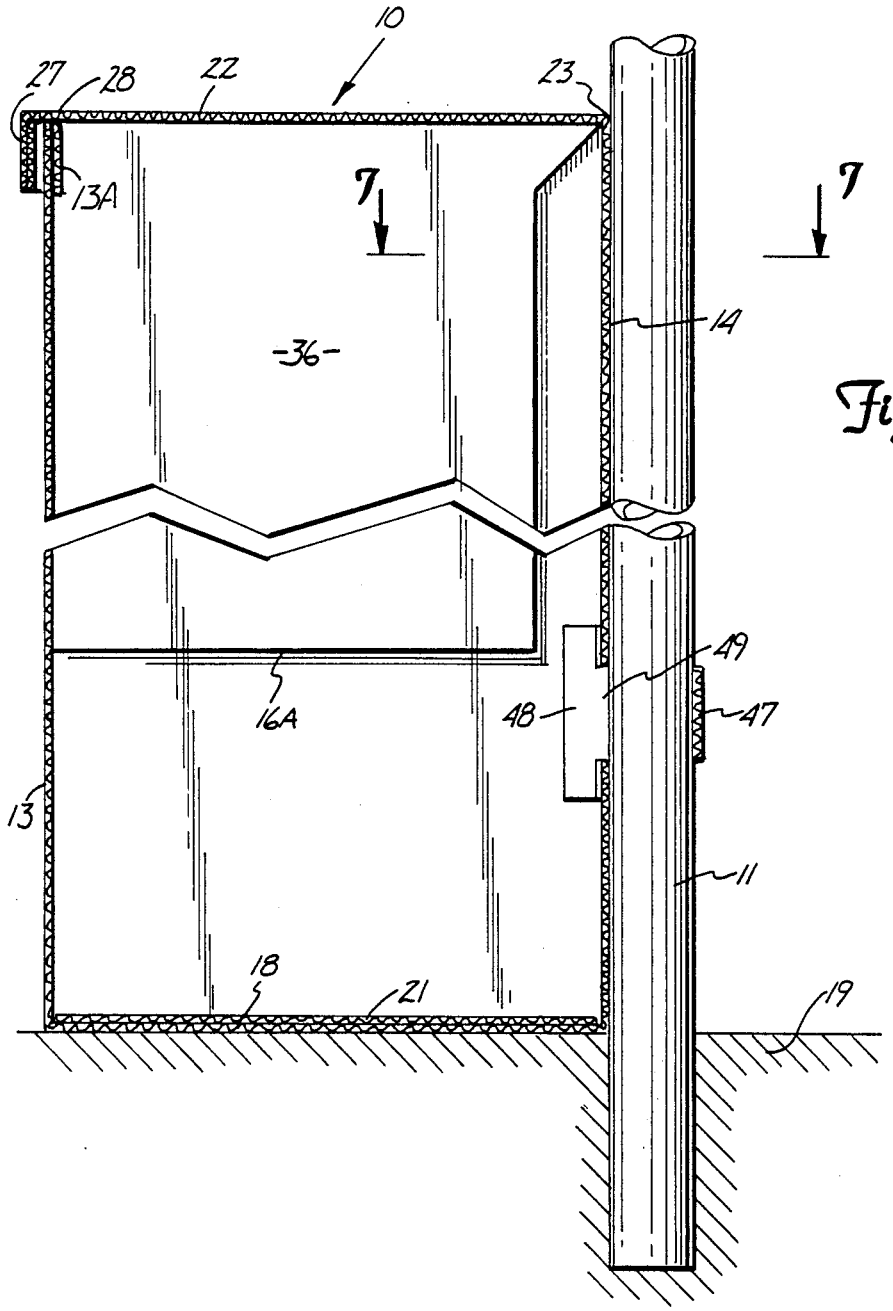
FIG. 3 is a foreshortened enlarged sectional view taken along the line 3—3 of FIG. 1.

Referring to FIGS. 1 to 3, there is shown a trash container of the invention indicated generally at 10, for storing paper, bottles, glass cans, and like trash. Container 10 can be used to store bulk materials in indoor and outdoor locations. Container 10 accommodates a plastic bag 37, such as a polyethelene bag, that can be removed to transport the trash to a disposal or recycling center. Container 10 is located adjacent and upright post 11 anchored to ground 19. Post 11 serves as a fixed member for retaining container 10 in a selected location. The fixed member can be any stationary object usable to hold container 10 in an upright position.

Container 10 has a generally upright rectangle box 12 having a cover 22 that can swing to an open position, as shown in broken lines in FIG. 1, to open the top of the box. Plastic bag 37 is located within chamber 36 of the box. Box 12 has a upright generally flat front wall 13 and a rear flat wall 14. Side walls 16 and 17 join with front and rear wall 13 and 14 and a bottom wall 18 to form a generally rectangular container or box 12. As shown in FIG. 3, a rectangular bottom panel 21 fits over the folded sections of bottom wall 18 to reinforce the bottom of the box.

A cover 22 has a hinge section 23 that is integral with the top of back wall 14. Hinge section 23 has a crease or fold line that joins back wall 14 and cover 22. Cover 22 has side lips 24 and 26 and a front lip 27. Front lip 27 has a back section 28 folded behind front lip 27. Back section 28 has a pair of upwardly directed tabs 29 and 30. As shown in FIG. 4, tabs 29 and 30 fit upwardly through slits 31 and 32 in the cover to hold the front lip 27 and a back section 28 in a folded side-by-side position. The side lips 24 and 26 have folded ears 33 and 34 that are inserted between front lip 27 and back section 28.

Figure 5:
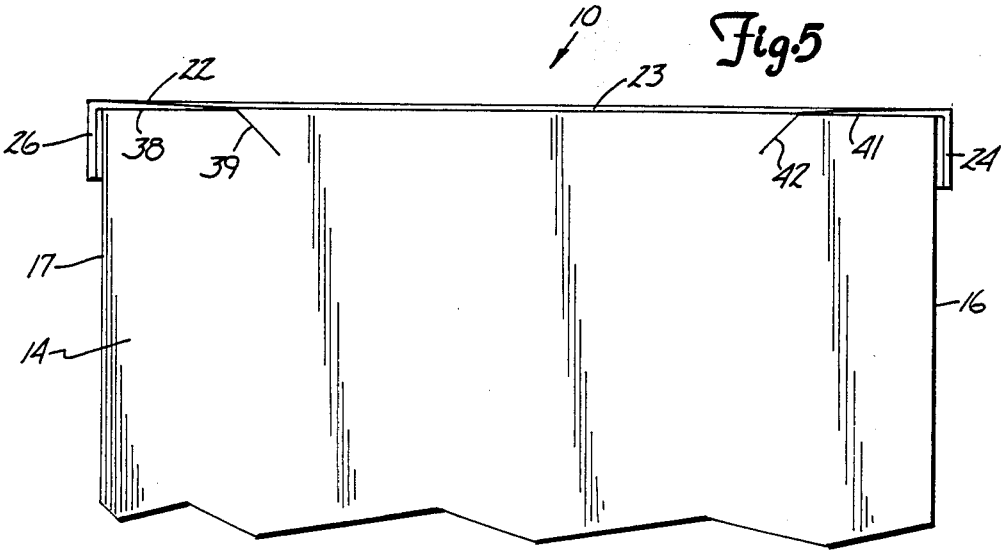
FIG. 5 is an enlarged rear elevational view of the upper portion of the rear wall of the container.

As shown in FIG. 5, opposite sides of cover 22 have inwardly directed grooves 38 and 41. Grooves 38 and 41 are in general alignment with opposite ends of hinge section 23. Downwardly and inwardly directed slits 39 and 42 are joined to the inner ends of grooves 38 and 41. As shown in FIGS. 2 and 6, the upper portions of bag 37 are inserted into groove 38 and 41 and forced down into slits 39 and 42. The remaining portions of bag 37 are dropped over the upper edges of the side walls 16 and 17 and front wall 13 of the box. When the top of bag 37 is moved down into slits 39 and 42 the entire upper end of bag 37 is retained in tight engagement with the top of box 12. This prevents bag 37 from collapsing and falling into box chamber 36 and separating from container 10.

Figure 7:
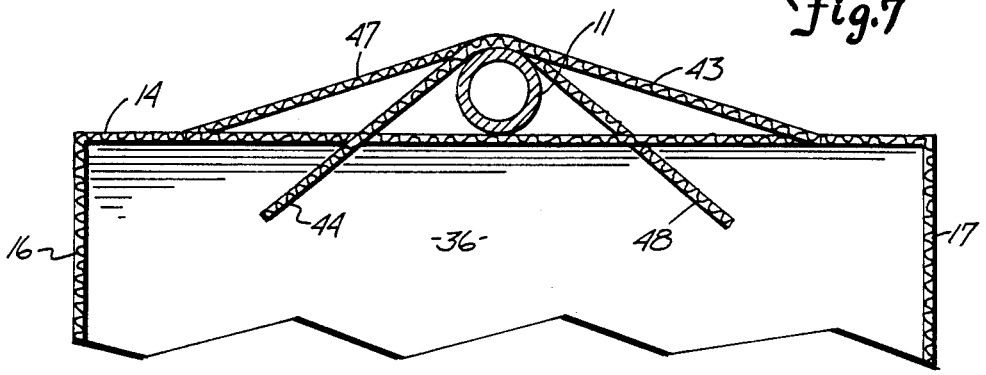
FIG. 7 is an enlarged sectional view taken along the line 7—7 of FIG. 3.

As shown in FIGS. 2 and 7, a releasable retainer is used to connect container 10 to post 11. The retainer comprises a pair of straps 43 and 47 that loop around post 11. Strap 43 has an end joined to one side of back wall 14 and an enlarged cross head 44 that fits into a T-slot 46 in the middle of the rear wall 14 of box 14. Strap 42 has an end joined to an opposite side of back wall 14 and an enlarged cross head 48 that fits into a second T-slot 49 in the lower portion of back wall 14 of box 14. The T-slots 46 and 49 are horizontally aligned with straps 43 and 47 and in opposite horizontal directions. Strap 43 and cross head 44 is a cut-out part of back wall 14. Strap 47 and cross head 48 is another cut-out of back wall 14. Straps 43 and 47 follow the outline of T-slots 46 and 49.

As shown in FIG. 8, container 10 is made from a single sheet member of blank 51. Blank 41 is a one-piece sheet member of corrugated paper, plastic, wood, or like foldable material. The sheet member can be coated with material that resists water, snow, ice and the like. Suitable printed matter can be applied to the container. The front back and side walls are separated with longitudinal parallel crease lines to facilitate the folding of the container into a box. Side walls 16 and 17 have top panels 16A and 17A adapted to be folded down in the chamber 36 or inside of container 10. Front panel 13 has a short top panel 13A that folds down adjacent side panels 16A and 17A to hold the side panels adjacent the inside of side walls 16 and 17 and front wall 13. Bottom wall 18 comprises folding bottom panels 18A, 18B, 18C, and 18D. Panels 18A–18D interlock with each other when folded in a generally horizontal rectangular configuration to form bottom wall 18.

Cover 22 has side flanges 24 and 26 with generally triangular ears 33 and 34 respectively. The ears 33 and 34 fold 90 degrees toward each other and are inserted between front lip 27 and back section 28 during the folding of lip 28. Tabs 29 and 30, when inserted into slits 31 and 32 maintain the rectangular configuration of flanges 24 and 26 and lip 27.

Side wall 17 has a longitudinal side flange 17B that is used to secure side wall 17 to an edge of front wall 13. Suitable adhesives, bonding materials and the like are used to secure flange 17B to the inside edge of front wall 13 to hold container 10 in a generally upright box shape.

In use, container 10 is stored and shipped in a flat condition. Blank 51 can be folded along fold line 52 to reduce its size. The flange 17B is secured with an adhesive front wall 13. Container 10 is set up by folding front wall 13 and side walls 16 and 17 to generally normal locations and interlocking bottom panels 18A–18D. Bottom panel 21 is then placed on top of folded bottom panels 18A–18D. Top panels 16A and 17A are folded down into the inside of container 10. Front flap 13A is then folded down to hold side panels 16A and 17A in position. Cover 22 is made by folding front lip 28 to locate tabs 29 and 30 in slits 31 and 32. Ears 33 and 34 are moved into opposite ends of the folded front lip.

A flexible bag 37, such as a plastic bag, is located in box chamber 36. The upper end of bag 37 is draped over the upper edges of the box. The rear section of bag 37 are moved into grooves 38 and 41 and down into slits 39 and 42. This holds the upper portion of bag 37 in a tight relationship relative to the top of container 10. Cover 22 closes the top of the open bag 37. Side flanges 24 and 26 and folded front lip 27, 28, as shown in FIGS. 1 and 2 are located around the dropped upper end of bag 37. Cover 22 can be readily swung to an open position as shown in broken lines in FIG. 2 to provide access to open bag 37.

Container 10 can be attached or connected to upright post 11 with use of retainer straps 43 and 47. Straps 43 and 47, along with their heads 44 and 48, are removed from the T-shaped slots in back wall 14. The one end of each straps 44 and 47 is integral with the back wall 14. After strap 43 and 47 are placed around post 11, as shown in FIG. 2, heads 44 and 48 are inserted into T-slots 46 and 49 to hold straps 43 and 47 about posts 11. Retainer straps 43 and 47 hold container 10 in an upright position adjacent post 11. Cover hinge 23 is located adjacent post 11 whereby cover 22 can be raised to open container 10. Post 11 prevents cover 22 from folding back and remaining open.

While there has been shown and described preferred embodiments of the trash container of the invention, it is understood that changes in structure, materials, sizes, and shapes can be made by those skilled in the art without departing from the invention. The invention is defined in the following claims.

The embodiments of the invention in which an exclusive property or privilege is claimed are defined as follows:

1. A container having a chamber accommodating a bag comprising: a box having front, rear, and side walls providing a chamber, said walls having upper edges surrounding an open top, cover means movably connected to the upper edge of the rear wall with hinge means for selectively opening and closing the open top, said cover means having a top wall and front and side flanges joined to the top wall, said front and side flanges extended over upper portions of the front and side walls of the box when the cover means is in the closed position over the open top of the box, said box, cover means and hinge means are folded and shaped from a single sheet member having fold lines to facilitate folding and shaping of the box and cover means, said hinge means having opposite ends, inwardly directed slots aligned with said opposite ends of the hinge means, said rear wall having downwardly directed slits open to the slots, said slots and slits accommodating separate portions of a bag when located in the chamber to hold the bag in engagement with the upper edges of the walls of the box, said inwardly directed slots being between the upper edge of the back wall of the box and the top wall of the cover means, said hinge means including the fold line between the back wall of the box and the top wall of the cover means whereby the cover means is integral with the back wall of the box, a plurality of strap means joined to the rear wall to couple the box to a fixed object, each of said strap means having a first end joined to the rear wall and a second end having an enlarged cross head means, and a plurality of generally T-shaped slot means in the rear wall aligned with the strap means, said cross head means extendible through a T-shaped slot means and engageable with the rear wall to form loops used to couple the box to a fixed object.

2. The container of claim 1 wherein: the front, rear, and side walls are joined to a bottom wall, said bottom wall having interconnecting panels.

3. The container of claim 1 wherein: the front, rear, and side walls have panels that extend downwardly adjacent the front and side walls to reinforce the box.

4. The container of claim 1 wherein: the slots have inner ends, said downwardly directed slits being open to the inner ends of the slots for accommodating portions of the bag.

5. The container of claim 1 wherein: said rear wall means has first and second side portions, one of said strap means joined to the first side portion and the other of said second strap means joined to the second side portion whereby said strap means extend in opposite directions relative to each other to form loops used to couple the box to a fixed object.

6. A container for accommodating a removable bag comprising: a box having a front wall, a rear wall, and side walls joined together providing a chamber, said walls having upper portions surrounding an open top, cover means having a top wall hinged to the upper portion of the rear wall for selectively opening and closing the open top, hinge means including a fold line integrally joining a portion of the top wall of the cover means to the upper portion of the rear wall whereby the cover means can be selectively moved to open and closed positions, said hinge means having opposite ends aligned with inwardly directed slots in opposite ends of the fold line and said rear wall having downwardly directed slits open to the slots for accommodating separate portions of an open end of a bag when located in the chamber, strap means having a first end joined to the rear wall and a second end having an enlarged head means, and slot means in said rear wall generally aligned with said strap means, said head means extendible through the slot means and engageable with the rear wall to form a loop used to couple the box to a fixed object.

7. The container of claim 6 wherein: said cover means has front and side flanges joined to the top wall, said flanges being extended over upper portions of the front wall and side walls when the cover means is in a closed position.

8. The container of claim 6 wherein: said strap means includes a first strap and a second strap, said first strap having a first end joined to one side of the rear wall and a second end having an enlarged cross head, said second strap having a first end joined to the opposite side of the rear wall and a second end having an enlarged cross head, said rear wall having a pair of slot means aligned with a first and second straps, said cross heads extended through said slots to form a pair of loops used to couple the box to a fixed object.

9. A container comprising: box means having generally upright wall means and a bottom wall surrounding a chamber having an open top, cover means having a top wall hinged to said upright wall means for selectively opening and closing the open top of the box means, hinge means including a fold line integrally joining a portion of the top wall of the cover means to the upright wall means, said hinge means having opposite ends aligned with inwardly directed slots in the opposite ends of the fold line, said upright wall means having downwardly directed slits open to the slots for accommodating separate portions of a bag when located in the chamber to hold the bag on said upright wall means.

10. The container of claim 9 wherein: the slots have inner ends, said downwardly directed slits being open to inner ends of the slots for accommodating portions of the bag.

11. The container of claim 9 including: retainer means joined to said upright wall means for holding the box means adjacent a fixed object.

12. The container of claim 11 wherein: the retainer means includes at least one strap means having a first end joined to the wall means and a second end, an enlarged cross head joined to the second end, said wall means having slot means aligned with said strap, said cross head extendible through said slot means to form a loop with said wall means to couple the box means to a fixed object.

13. The container of claim 12 wherein: the retainer means includes a pair of vertically spaced strap means adopted to loop around a fixed object, each strap means having a first end joined to the wall means and a second end, an enlarged cross head joined to the second end, said wall means having a pair of slot means aligned with the strap means, said cross heads extendible through said slot means to form with the wall means said loop around a fixed object.

14. The container of claim 13 wherein: the wall means has first and second side portions, the first end of one strap means is joined to the first side portion of the wall means, and the first end of the other strap is joined to the second side portion of the wall means whereby said pair strap means extend in opposite directions relative to each other to form a pair of loops used to couple the box to a fixed object.

15. The container of claim 9 wherein: said box means, cover means, and hinge means are folded and shaped from a single sheet member having fold lines to facilitate forming of the box means and cover means.

16. The container of claim 9 wherein: said cover means has front and side flanges joined to the top wall, said flanges being extended over upper portions of the upright wall means when the cover means is in a closed position.

17. The container of claim 9 wherein: upright wall means have panels that extend downwardly adjacent the inside portions of the upright wall means to reinforce the box.

* * * * *